US006893173B2

(12) United States Patent
McNally et al.

(10) Patent No.: US 6,893,173 B2
(45) Date of Patent: May 17, 2005

(54) PRINTER CHASSIS SIDEWALL AND PLATEN ASSEMBLY

(75) Inventors: Stephen McNally, Vancouver, WA (US); Robert M. Yraceburu, Camas, WA (US); Jason Belbey, Vancouver, WA (US); Victor Bruhn, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 7 days.

(21) Appl. No.: 10/298,690

(22) Filed: Nov. 18, 2002

(65) Prior Publication Data

US 2004/0096257 A1 May 20, 2004

(51) Int. Cl.[7] ..... B41J 11/20; B41J 29/02

(52) U.S. Cl. ..... 400/58; 400/59; 400/692; 400/101; 400/93; 400/287

(58) Field of Search ..... 400/55–58, 607, 400/692, 54; 101/93, 287

(56) References Cited

U.S. PATENT DOCUMENTS

| | | | |
|---|---|---|---|
| 4,772,146 | A | 9/1988 | Saito et al. |
| 2002/0044812 | A1 | 4/2002 | Yamamoto |

FOREIGN PATENT DOCUMENTS

| | | |
|---|---|---|
| DE | 29506430 | 6/1995 |

OTHER PUBLICATIONS

EP Search Report for EP App: EP 03013551, Mar. 16, 2004, Ex. T. Joosting.

*Primary Examiner*—Daniel J. Colilla
*Assistant Examiner*—Marissa Ferguson

(57) ABSTRACT

The present invention provides a printer having a platen, a chassis sidewall and an attachment portion connecting the platen to the chassis sidewall. The attachment portion biases the platen toward the chassis sidewall.

38 Claims, 8 Drawing Sheets

PRINTER CHASSIS SIDEWALL AND PLATEN ASSEMBLY

BACKGROUND OF THE INVENTION

In conventional image transfer devices, such as printers, a platen is often provided to support print media, such as paper, during printing. The platen provides a support surface for the media in the region of the printer in which printing occurs. Desirably, the platen maintains the media in a substantially flat profile during printing. This helps alleviate print defects such as paper jams and protect against potential damage to the printer. In some situations, the platen can be warped due to moments exerted by the mounting features of the platen and by associated fasteners. This problem can be aggravated if the platen is formed of lightweight, thin, stamped material.

SUMMARY OF THE INVENTION

An embodiment of the invention is directed to a printer comprising a platen, a chassis sidewall, and an attachment portion connecting the platen to the chassis sidewall. The attachment portion biases the platen toward the chassis sidewall.

Other aspects and advantages of the present invention will become apparent from the following detailed description taken in conjunction with the accompanying drawings, illustrating by way of example the principles of the invention.

BRIEF DESCRIPTION OF THE DRAWINGS

The present invention will now be described, by way of example, with reference to the accompanying drawings, in which.

DETAILED DESCRIPTION OF PREFERRED EMBODIMENTS

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes that come within the meaning and range of equivalency of the claims are to be embraced within their scope.

Figure 1:
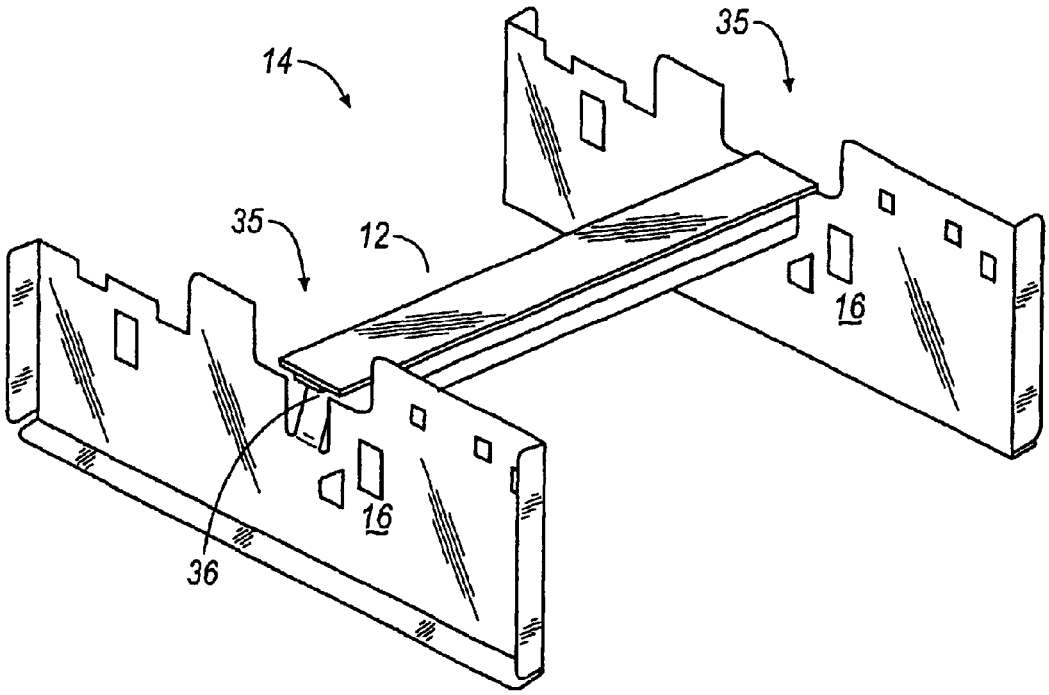
FIG. 1 is a perspective view illustration of a platen attached to chassis sidewalls according to a first embodiment of the present invention.
Figure 2:
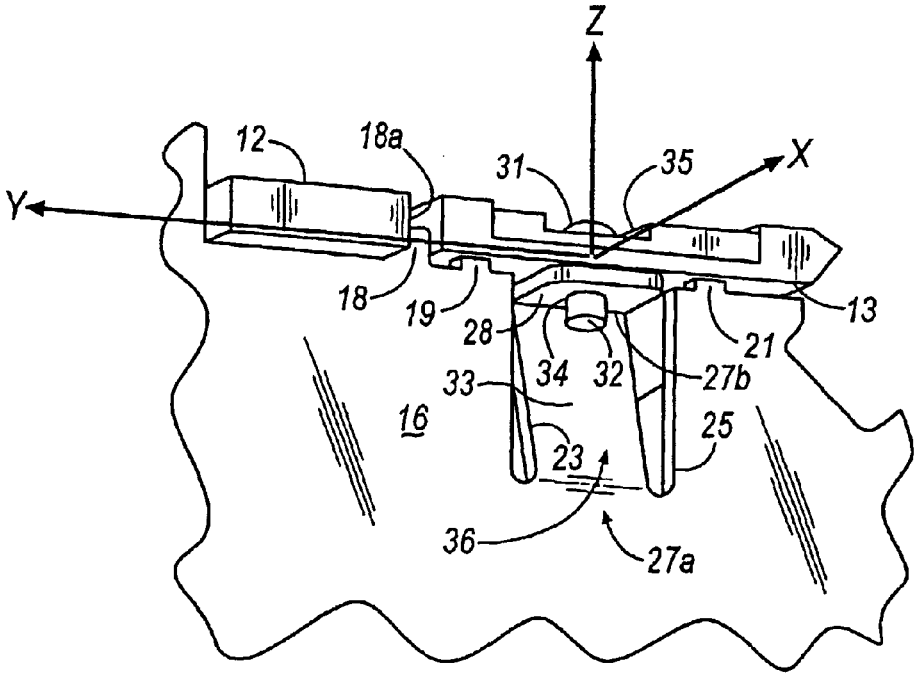
FIG. 2 is a perspective view illustration of a platen attached to a chassis sidewall according to the first embodiment of the present invention.
Figure 3:
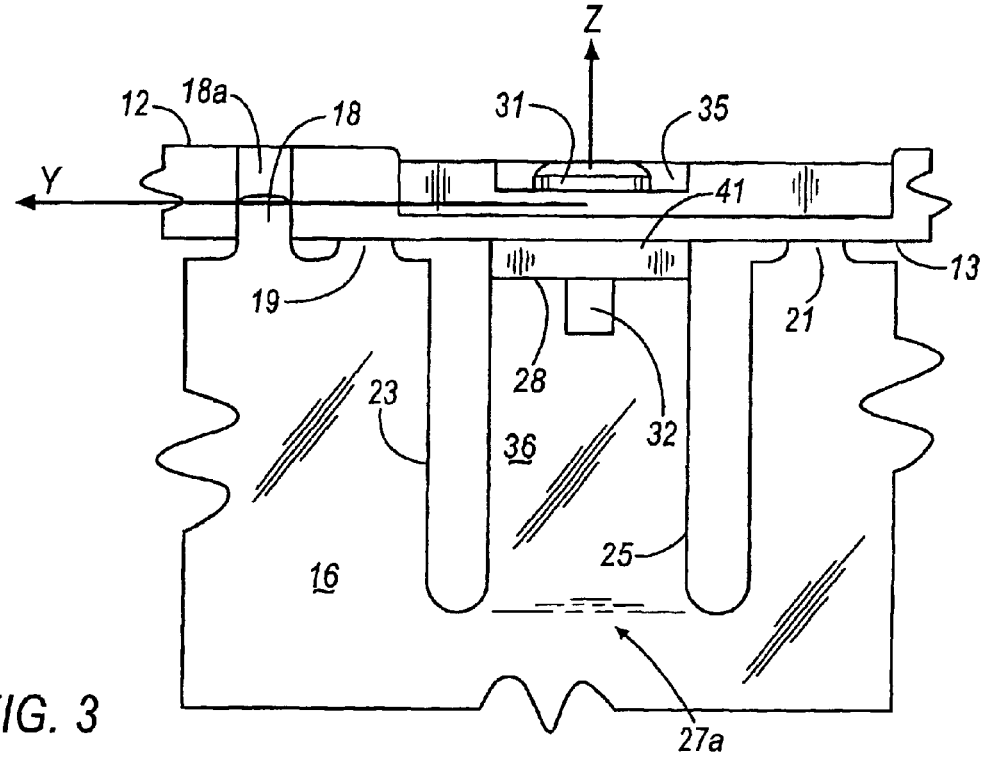
FIG. 3 is a side view illustration of a platen attached to a chassis sidewall according to the first embodiment of the present invention.

Referring now to FIGS. 1–3, a chassis platen assembly 14 according to one embodiment of the present invention is shown and described. By way of the non limiting example depicted in FIG. 1, the chassis platen assembly 14 includes a pair of opposed chassis sidewalls 16 with platen 12 connected thereto. Recesses 35 are formed in an upper portion of each of the chassis sidewalls 16, in which platen 12 is positioned. Platen 12 is connected to the chassis sidewalls 16 at respective attachment portions 36, as will be described in greater detail hereinafter.

The illustrations depicted in FIGS. 2–8 illustrate constructions of one of the chassis sidewalls 16. It is understood that both chassis sidewalls 16 contain features similar to those illustrated in each of the figures. However, it will be understood by one skilled in the art that modifications and variations between each of the sidewalls and combinations of any of the illustrated preferred embodiments may be incorporated into chassis platen assembly 14.

FIG. 2 illustrates an embodiment of the present invention in which a locking datum tab 18 is integrally formed with the sidewall 16. The locking datum tab 18 generally extends from chassis sidewall 16 and projects toward the platen 12 (in the assembly orientation of platen 12 and chassis sidewall 16). In one embodiment, locking datum tab 18 is received in receiving formation 18*a* in platen 12 to prevent movement of platen 12 along the Y-axis direction relative to the chassis sidewalls 16. It is understood, however, that other means and methods for restraining movement of platen 12 along the Y-axis direction may be effectuated, and the present invention is not limited to that disclosed herein. By way of example of one such variation, platen 12 can include locking datum tab 18 formed integrally therein while chassis sidewall 16 contains receiving formation 18*a*. One skilled in the art will appreciate that other modifications and variations are possible without deviating from the scope of the invention.

One or more support datum tabs are integrally formed in each chassis sidewall 16. In a preferred embodiment, support datum tabs 19 and 21 extend from chassis sidewall 16 in a direction toward platen 12 (in the assembly orientation of platen 12 and chassis sidewall 16). Datum tabs 19 and 21 provide locating surfaces on which to position and locate platen 12 along the Z-axis for proper assembly to chassis sidewalls 16. Support datum tabs 19 and 21 position the platen with respect to the chassis sidewalls 16 and other components generally included with the image transfer device for which the present invention is applied.

In the embodiments depicted in FIGS. 2–3, attachment portion 36 is integrally formed with chassis sidewall 16. Attachment portion 36 extends from chassis sidewall 16, through leg 33, terminating at mounting tab 28. Chassis sidewall 16 preferably includes one or more flex portions 27*a* and 27*b*. Leg 33 preferably integrally connects to mounting tab 28 and chassis sidewall 16 via flex portions 27*a* and 27*b*. Although the resulting shape depicted is a Z shape, it will be understood by one skilled in the art that other modifications and configurations are possible without deviating from the scope of the invention. Leg 33 is separated from chassis sidewall 16 by voids 23 and 25 to allow movement of leg 33 when chassis sidewall 16 is attached to platen 12 as will be described in greater detail.

A fastening member 31, such as a screw, bolt or other threaded means, has a shank 32 that extends through an opening in platen 12 and engages an aperture 34 in mounting tab 28. Fastening member 31 affixes platen 12 to the chassis sidewall 16. It should be noted, however, that fastening member 31 is one representative example of a fastening means used in conjunction with the present invention, and that modifications and variations are ascertainable by one skilled in the art. By way of a non-limiting example, the fastening member 31 could also be a pop rivet, adhesive, welding or other similar or known fastening means.

Figure 5:
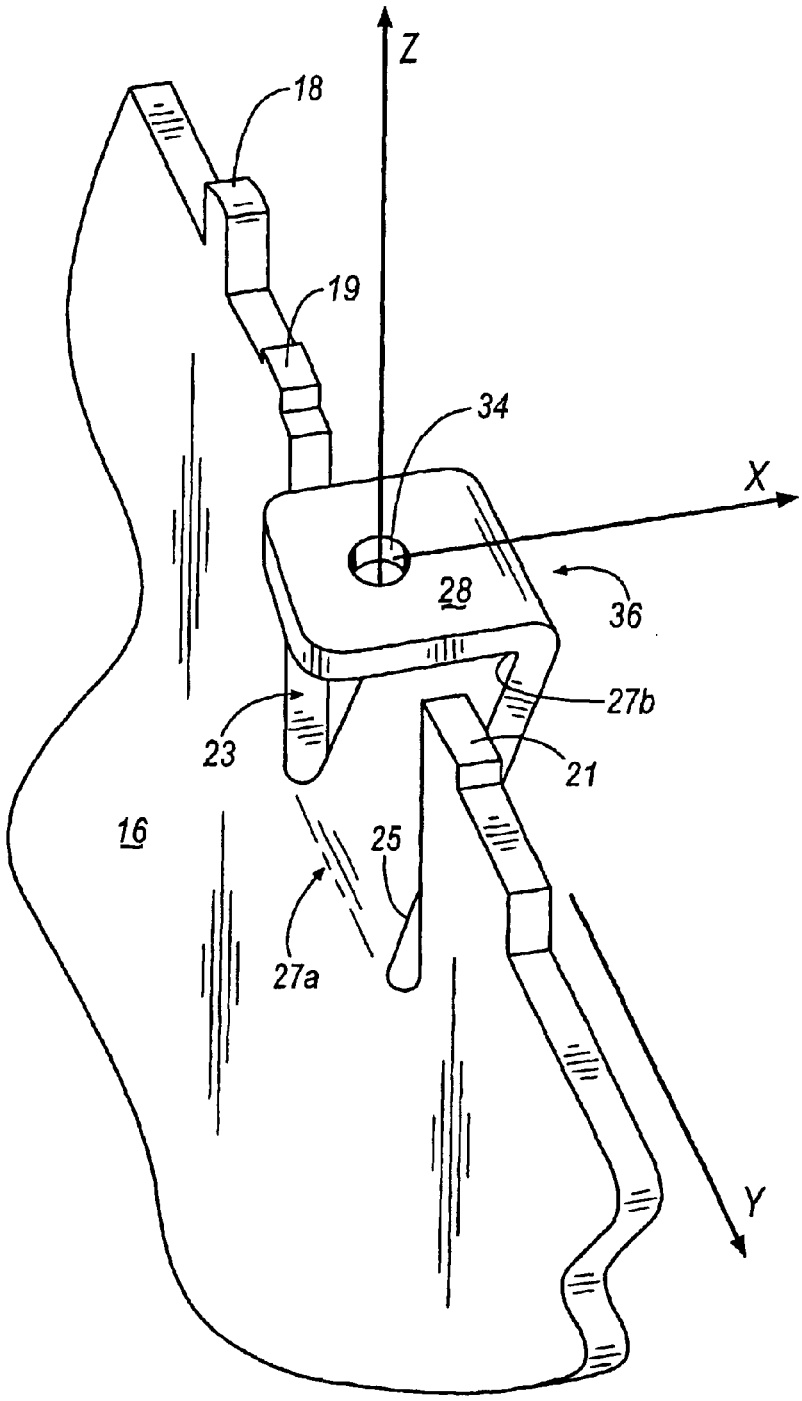
FIG. 5 is a perspective view illustration of a chassis sidewall according to the first embodiment of the present invention.

As best understood with respect to the non-limiting example of FIG. 5, the centerline of aperture 34 is aligned with tabs 18, 19, 21 and chassis sidewall 16 with respect to the X-axis. As a result, no moment is created about the Y-axis when fastening member 31 is connected to mounting tab 28. When platen 12 is connected to the mounting tab 28, platen 12 rests on the datum tabs 19 and 21.

To minimize the moment about the X-axis, datum tabs 19 and 21, each located on an opposite side of the fastening member 31 along the Y-axis, provide support and resistance to rotation of platen 12 about the X-axis. As such, when the fastening member 31 is tightened during attachment of platen 12 to mounting tab 28, mounting tab 28 is pulled toward contact with the platen undersurface 13. In this manner, the Z-axis location is not lost because mounting tab 28 acts as a biasing spring/feature, not a mounting feature, as will be described in greater detail.

Figure 4:
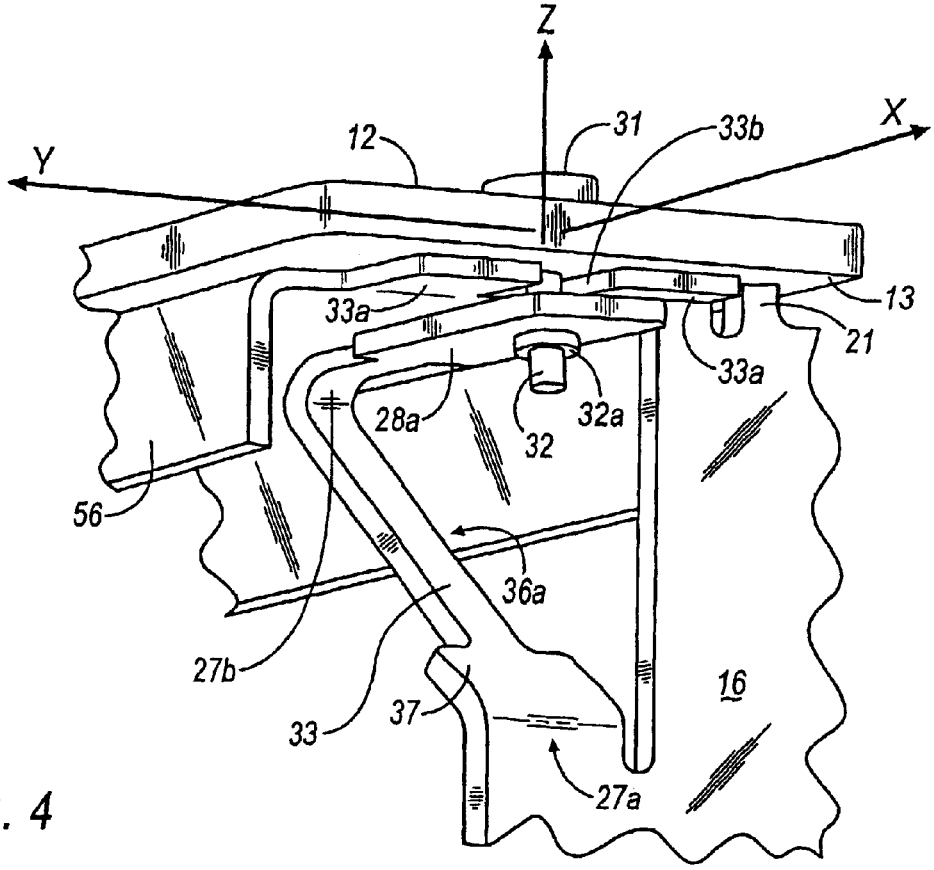
FIG. 4 is a perspective view illustration of a platen attached to a chassis sidewall according to a second embodiment of the present invention.

With reference to FIG. 4, another embodiment of the invention is shown having a modified attachment portion 36*a*. Attachment portion 36*a* is similar in function to that shown and described with reference to FIG. 2. However, attachment portion 36*a* includes a shoulder 37 integrally connected to the sidewall 16. Leg 33 is interposed between and integrally connected to shoulder 37 and a mounting tab 28*a*. Shoulder 37 is typically wider than leg 33 to provide additional support for attachment portion 36*a*. The thicker shoulder 37 provides increased support to resist plastic deformation or shearing from torque generated from the rotation of fastening member 31.

As shown in FIG. 4, additional support of platen 12 can be provided by a transverse support 56 that is disposed between chassis sidewall 16. The support as illustrated includes a pair of laterally projecting ears 33*a* that help define a receiving formation 33*b*. The shank 32 of the fastening member 31 passes through the receiving formation 33*b* to engage an extruded hole 32*a*, located at the underside of the mounting tab 28*a*. It will be evident that there are additional embodiments and applications that are not disclosed in the detailed description but which clearly fall within the scope of the present invention.

Figure 2A:
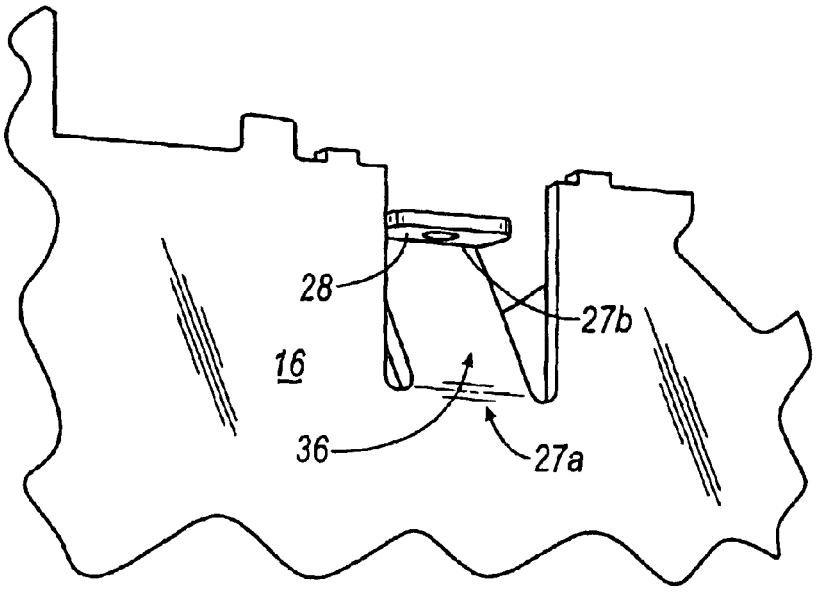
FIG. 2*a* is a perspective view illustration of a chassis sidewall before assembly according to the first embodiment of the present invention.
Figure 2B:
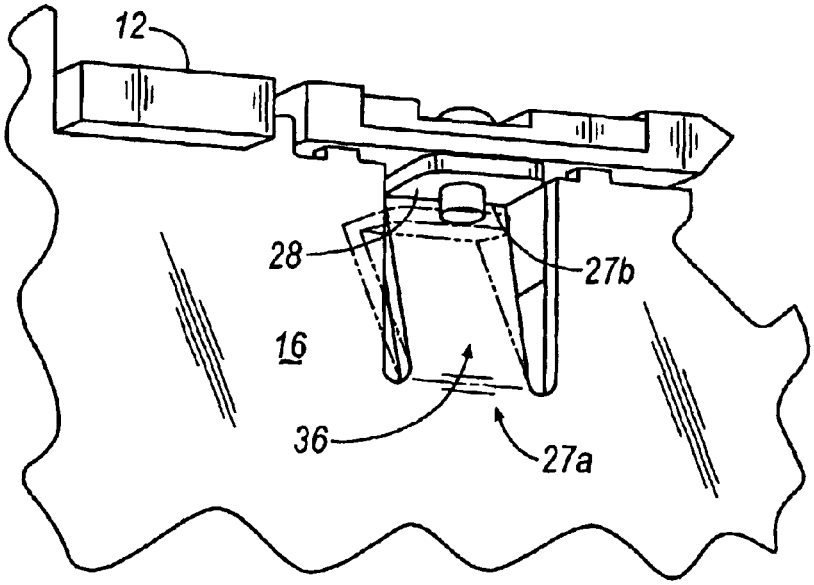
FIG. 2*b* is a perspective view illustration of a chassis sidewall after assembly according to the first embodiment of the present invention.

With reference to FIGS. 1–5 and 9, a preferred embodiment of the assembly and operation of the above described embodiments of the present invention is shown and described by way of a non-limiting example. In step 64 of FIG. 9, fastening members 31 such as screws are passed through apertures in platen 12 and threaded to apertures 34 in mounting tabs 28. In step 66, fastening members 31 are then secured to mounting tabs 28 until flex portions of the attachment portions 36*a* are flexed and tabs 19 and 21 are compressed against platen 12 for positioning of platen 12. Attachment portion 36*a* is connected to platen 12 and chassis sidewall 16 at distances to create a mechanical bias in the attachment portion 36 and draw platen 12 and chassis sidewall 16 toward each other along the Z axis. Specifically, referring to FIGS. 2*a* and 2*b*, "before" and "after" assembly configurations of attachment portion 36 are shown. In FIG. 2*a*, attachment portion 36 is shown in its "un-sprung and un-flexed" initial state. When attachment portion 36 is attached to platen 12 as shown in FIG. 2*b*, attachment portion 36 is stretched to its "sprung" position, causing platen 12 to be drawn toward chassis sidewall 16. The spacing of locations where attachment portion 36 connects to platen 12 and chassis sidewalls 16 stretch attachment portion 36 to establish a "sprung" state or condition.

Flex portions 27*a* and 27*b*, as well as the remainder of attachment portion 36, preferably allow mounting tabs 28 to move at least in the Z and X directions. Accordingly, due to the flexibility of attachment portion 36, torsional stresses induced by fastening member 31, which are at least partially due to movement of the mounting tabs 28*a* toward platen 12, are generally absorbed by attachment portion 36 and not by platen 12. As such, as the stress in platen 12 is lessened, stresses caused variations in platen 12 are reduced, and platen 12 is better maintained in its preferred substantially flat configuration. Flexing of mounting tabs 28 also provides additional reduction of the bending load on platen 12 when assembled to chassis sidewalls 16. To further reduce movement in the X-direction, the attachment portion 36 can commonly be made more flexible by utilizing a thinner leg 33. Making the attachment portion 36 more flexible allows the attachment portion 36 to have controllable Z-axis hold-down forces. By way of a non-limiting example, if one desires to increase the amount of force exerted between platen 12 and chassis sidewall 16, the flexibility of attachment portion 36 can be reduced, thereby creating increased Z-axis hold-down forces when the platen is attached to the attachment portion 36*a*.

Figure 6:
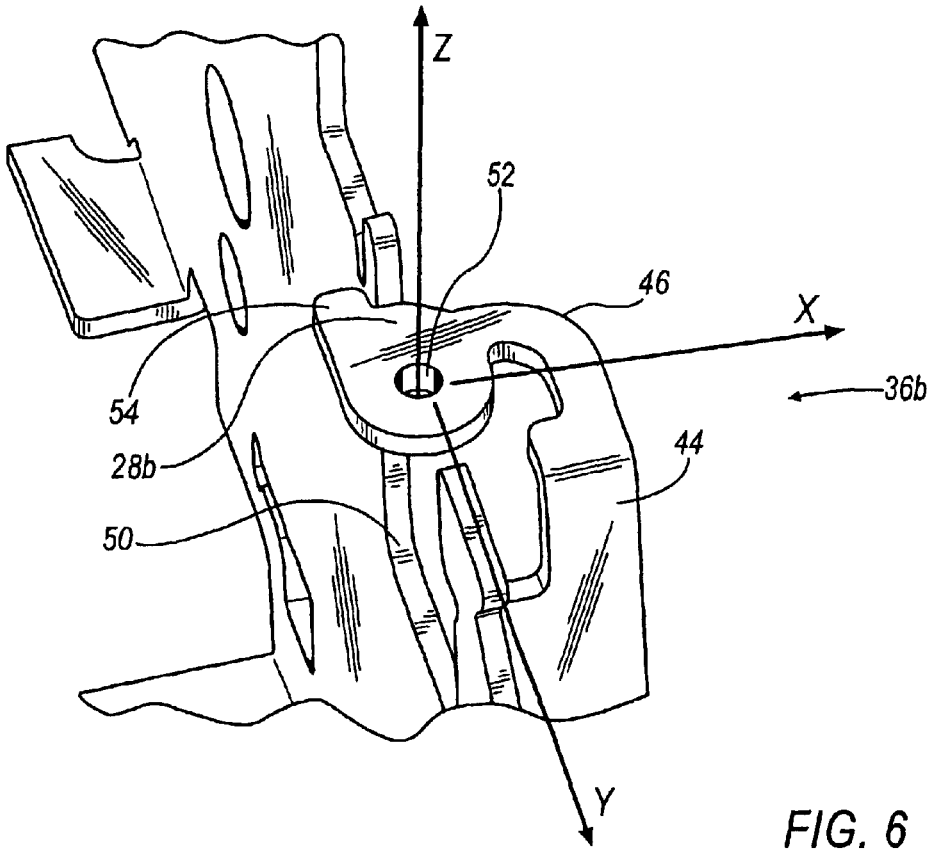
FIG. 6 is a perspective view illustration of a chassis sidewall according to a third embodiment of the present invention.

Referring now to FIG. 6, an attachment portion 36*b* of another embodiment is shown and described. By way of example, without limitation, FIG. 6 illustrates attachment portion 36*b* as including base portion 44, flex portion 46, and mounting tab 28*b*. Preferably, base portion 44 is integrally formed with an edge of aperture 50. However, it is understood that other alternate means may be employed for attaching base portion 44 to chassis sidewall 16 such as by fastening means, adhesion, welding or other suitable means.

By way of the example illustrated in FIG. 6, base portion 44 typically extends toward an interior area between opposing chassis sidewall 16 (with reference to FIG. 1). However, base portion 44 and the remainder of the attachment portion can alternatively extend outside the chassis sidewalls. Flex portion 46 integrally extends from the upper portion (in the Z direction) of base portion 44 and traverses substantially parallel to a mating face of platen 12 (in an assembly configuration of platen 12 and chassis sidewall 16). A thickness in the X-axis direction of flex portion 46 is reduced with respect to that of base portion 44 to provide increased flexibility with respect to base portion 44 for reasons which will be discussed in greater detail hereinafter. It should be noted, however, that alternate modifications may be made to attachment portion 36*b* to provide flexibility qualities beyond that described herein. For instance, flex portion 46 may be constructed of a different material from that of base portion 44, which exhibits greater elastic deformation properties. Likewise, other modifications to the dimensional characteristics of flex portion 46 may be made in conjunction to base portion 44 to provide elastic deformation characteristics. Additionally, base portion 44 can be modified to exhibit flexibility characteristics, thereby eliminating flex portion 46 altogether. Moreover, it should be noted that the flexibility characteristics exhibited by this preferred embodiment may be elastic or plastic deformation.

Figure 7:
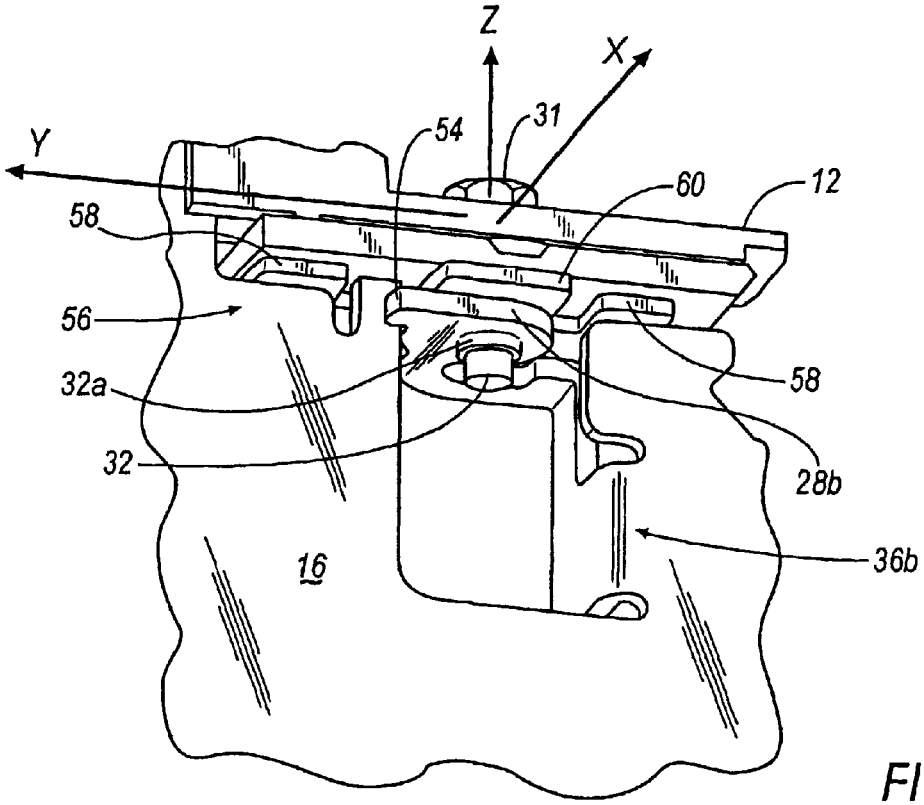
FIG. 7 is a perspective view illustration of a platen attached to a chassis sidewall according to the third embodiment of the present invention.
Figure 7A:
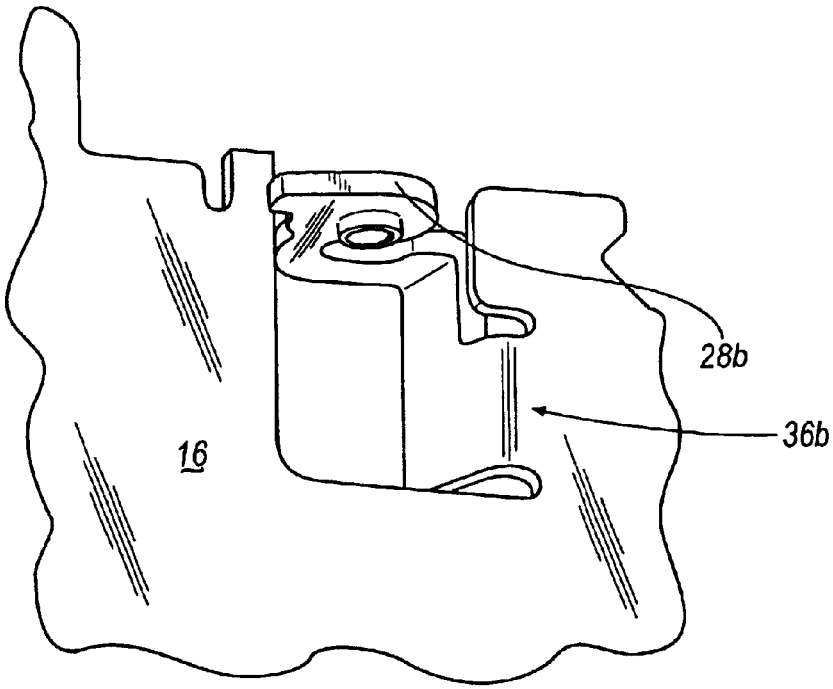
FIG. 7*a* is a perspective view illustration of a chassis sidewall before assembly according to the third embodiment of the present invention.
Figure 7B:
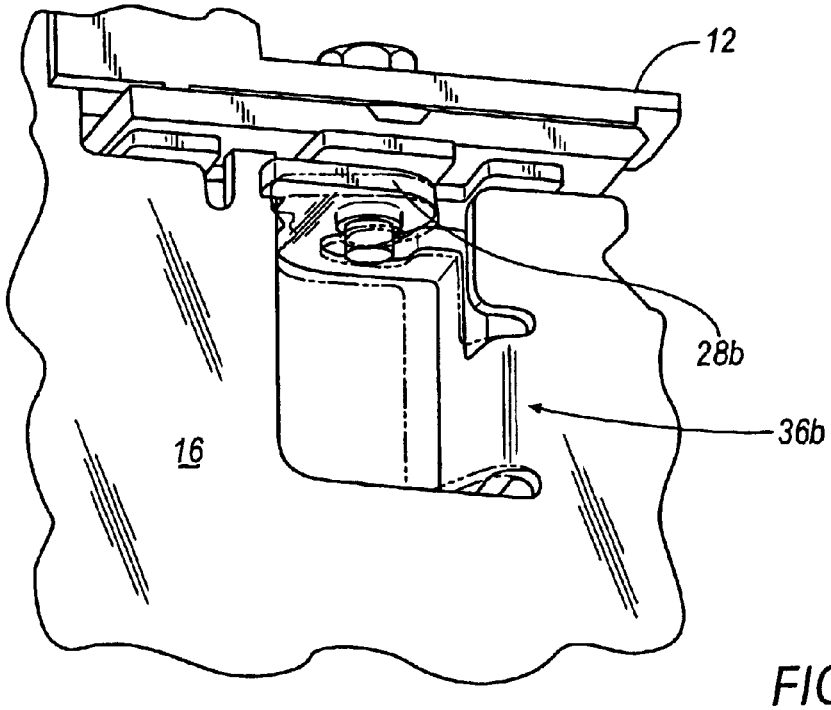
FIG. 7*b* is a perspective view illustration of a chassis sidewall before assembly according to the third embodiment of the present invention.

With reference to FIG. 7, a preferred embodiment of mounting tab 28*b* is described in greater detail. Mounting tab 28*b* has an aperture 34 (e.g., see FIG. 8) passing therethrough along the Z-direction. Preferably, mounting tab 28*b* is positioned substantially parallel to platen 12 (in the assembly orientation of platen 12 and chassis sidewall 16). In one embodiment, mounting tab 28*b* includes stop tab 54 that extends from mounting tab 28*b*. Stop tab 54 is proximate inner side of chassis sidewall 16 to prevent over-torqueing movement of mounting tab 28*b* with respect to chassis sidewall 16. Of course, depending on the orientation of the remainder of the attachment portion, stop tab 54 can also be proximate the outer side of chassis sidewall 16. Stop tab 54 is positioned on a counter clockwise position with respect to chassis sidewall 16 and looking downward with respect to the figure, such that rotation of fastening member 31 causes abutment of stop tab 54 with chassis sidewall 16 in the event of excessive torque, during threading, of fastening member 31 as will be described in greater detail.

Figure 8:
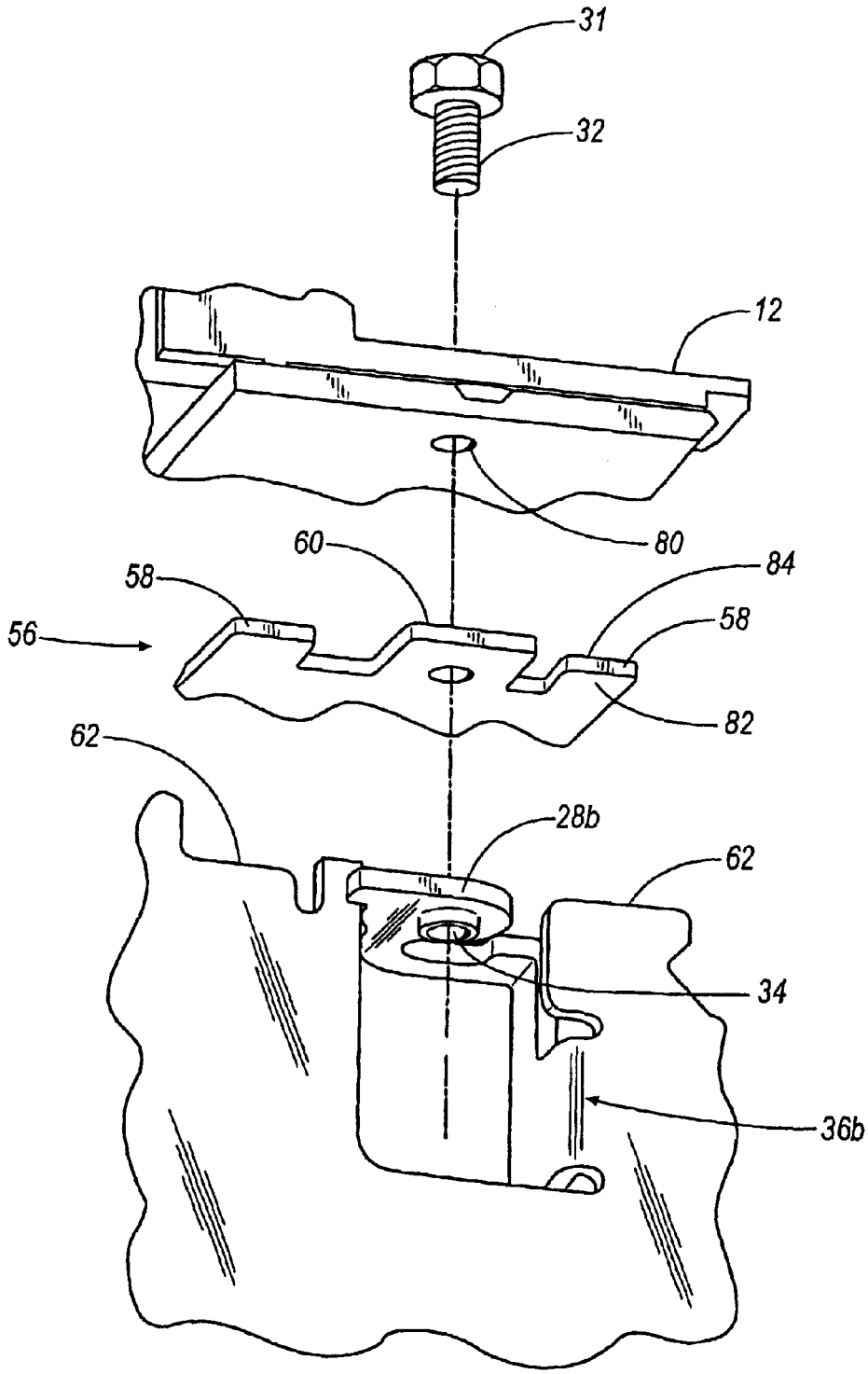
FIG. 8 is a an exploded perspective view illustration of a platen attached to a chassis sidewall according to the third embodiment of the present invention.
Figure 9:
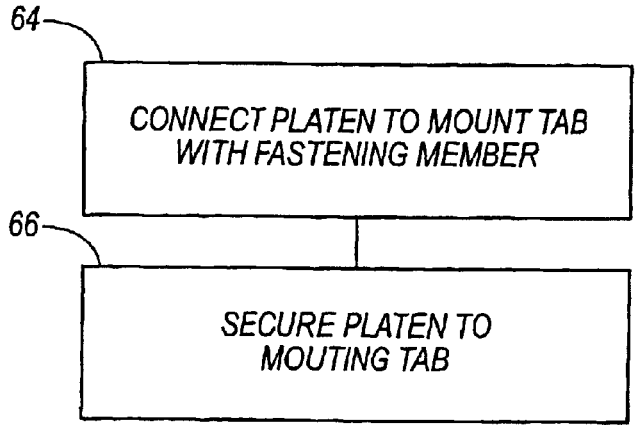
FIG. 9 is a flow diagram illustration of an assembly method of a platen to chassis sidewalls according to the embodiments of the present invention.

Referring now to FIG. 8, one attachment of mounting tab 28*b* to platen 12 is shown and described. A fastening member, such as a fastening member 31 having a shank 32 extends through an opening 80 in the platen 12. As in the previous embodiments, other fastening members beyond those described in the present figure may be used as a fastening means for securing platen 12 to mounting tab 28*b*. Preferably, the fastening member 31 is threaded to aperture 34 in mounting tab 28*b*. In one embodiment, the diameter of threads on shank 32 are sized slightly larger than the diameter of aperture 34. Accordingly, the threads of shank 32 machine corresponding threads in the inner diameter of aperture 34 of mounting tab 28*b* to create an inner locking engagement between shank 32 and mounting tab 28*b*. As described with reference to FIG. 7, the extruded hole 32*a* secures to threads of shank 32 for providing additional securing of mounting tab 28*b* to platen 12.

Mounting plate 56 is typically interposed between platen 12 and chassis sidewall 16. Mounting plate 56 includes locating tabs 58 and attachment tab 60. Each locating tab 58 has a bottom portion 82 that abuts locating surface 62 and a top portion 84 that abuts platen 12. The machining of locating surfaces 62 and locating tabs 58 in conjunction with the thickness of locating tabs 58 positions platen 12 at a desired level and orientation when platen 12 is secured to mounting tab 28*b* (see FIG. 8). Accordingly, in a similar manner as tabs 19 and 21 act to locate platen 12 in previously-described embodiments, locating tabs 58 work in conjunction with locating surfaces 62 of chassis sidewalls 16 to position platen 12 in a proper configuration with respect to components of the image transfer device for which the present invention is applied.

Figure 10:
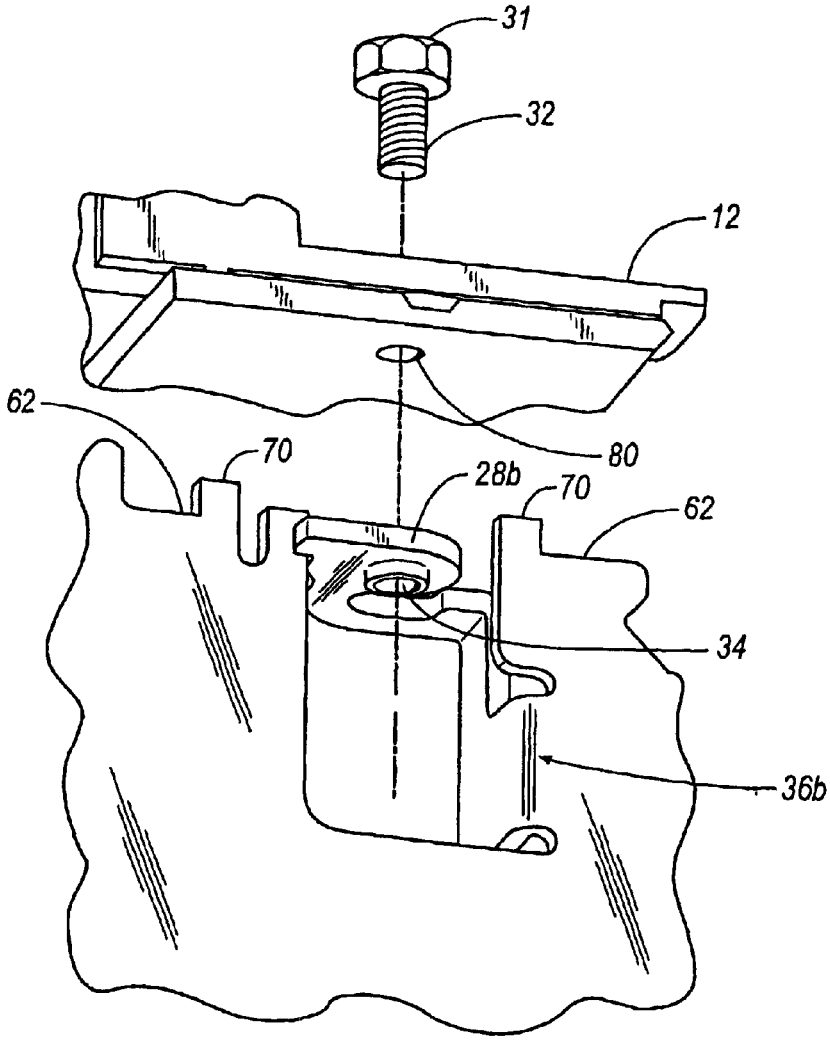
FIG. 10 is a front view illustration of a platen and chassis sidewall according to a fourth embodiment of the present invention.

With reference to FIGS. 6–9, an embodiment of the assembly and operation of the above described embodiment of the present invention is shown and described by way of a non-limiting example. In step 64 of FIG. 9, fastening members such as fastening members 31 are passed through apertures in platen 12, mounting plate 56 and threaded to apertures 34 in mounting tabs 28*b*. In step 66, fastening members 31 are then secured to mounting tabs 28 until flex portions of attachment portions 36*b* are flexed and locating tabs 58 are compressed between locating surfaces 62 and platen 12 for positioning of platen 12. As can be seen from the figure, attachment portion 36*b* is connected to platen 12 and chassis sidewall 16 at distances to create a bias in the attachment portion and draw platen 12 toward chassis sidewall 16 toward each other. Flex portion 46 of each attachment portion 36*b* as well as the remainder of attachment portion 36*b* allows mounting tab 28*b* to move in the X, Y and Z directions. Additionally, attachment portion 36 allows mounting tab 28*b* to rotate at least about the Z axis. Accordingly, due to the flexibility of attachment portion 36, torsional stresses induced by fastening member 31 due to turning and fastening are generally absorbed by attachment portion 36 and not by the platen 12. As such, the reduced stresses in platen 12 act to reduce variations therein and to maintain platen 12 in its preferred flat configuration. In some embodiments, to prevent over-flexing or over-rotation of mounting tab 28*b* about the Z axis, stop tab 54 (see FIG. 6) abuts chassis sidewall 16 at a predetermined torque of mounting tab 28*b* about the Z axis. However, stop tab 54 is not necessary for the operation of the present invention and may be omitted. One skilled in the art will also recognize that other types of stop features may be employed in the present invention, or that no stop features at all may be employed, and that the present invention is not limited to that disclosed in the figures or discussed herein. As shown in FIG. 10, the generally rectangular configuration of the present embodiment allows clearing for the assembly of platen 12 to be positioned adjacent to attachment portion 36*b*.

Referring to FIG. 10, another embodiment of the present invention is shown and described. Here, mounting plate 56 is replaced by tabs 70. Tabs 70 act as the locating surface for which to position platen 12 with respect to chassis sidewalls 16. Accordingly, with respect to the example assembly of the embodiment illustrated in FIG. 9, in step 64 of FIG. 9, fastening members such as fastening members 31 are passed through apertures in platen 12 and threaded to apertures 34 in mounting tabs 28*b*. In step 66, fastening members 31 are then secured to mounting tabs 28 until flex portions of the attachment portions 36*b* are flexed, tabs 70 are compressed against platen 12 for positioning of platen 12, and a predetermined amount of torque has been applied to the fastening member 31.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. A printer, comprising:

a platen;

a chassis sidewall; and an attachment portion connected to the platen and integrally formed as part of a single unitary body with the chassis sidewall and extending from the chassis sidewall such that the attachment portion is flexed to bias the platen toward the chassis sidewall.

2. The printer according to claim 1, further comprising:

a locking datum tab extending from the chassis sidewall; and a receiving formation in the platen;

wherein the locking datum tab resides in the receiving formation after the connection so as to prohibit movement of the platen with respect to the chassis-sidewall.

3. The printer according to claim 1, wherein the attachment portion includes at least one flex portion that provides the elastic bias to press the platen against the chassis sidewall.

4. The printer according to claim 3, further comprising:

a base portion attached to the chassis sidewall; and a mounting tab connectable to the platen by a fastening member;

wherein the flex portion connects to the base portion and suspending the mounting tab.

5. The printer according to claim 4, wherein:

the base portion extends substantially perpendicularly from the chassis sidewall and is integrally formed with the chassis sidewall;

the mounting tab has an aperture formed therein to receive the fastening member; and the mounting tab is substantially parallel to the platen.

6. The printer according to claim 4, further comprising a stop tab extending from the mounting tab, wherein the stop tab is positioned proximate to the mounting tab at a position counterclockwise from the chassis sidewall.

7. The printer according to claim 1, further comprising a least one support datum tab formed on the chassis sidewall and positioned against the platen to position the platen with respect to the chassis sidewall, wherein the attachment portion biases the platen against the support datum tab.

8. The printer according to claim 1, further comprising a mounting plate positioned between the chassis sidewall and the platen, wherein the attachment portion forces the mounting plate between the platen and the chassis sidewall.

9. The printer according to claim 1, further comprising:

a leg extending away from the chassis sidewall toward an inner area of the printer;

a flex portion connecting the leg with the chassis sidewall;

a mounting tab;

a second flex portion connecting the mounting tab to the leg; and a fastening member connecting the mounting tab to the platen;

wherein the flex portion and the second flex portion bias the platen toward the chassis sidewall.

10. The printer according to claim 1, further comprising:

a second chassis sidewall positioned on an opposite end of the platen with respect to the chassis sidewall;

a second attachment portion connecting the platen to the second chassis sidewall, the second attachment portion being configured to bias the platen toward the second chassis sidewall; and wherein a substantially flat surface of the platen is maintained in an unwarped condition.

11. The printer according to claim 1, wherein:

the platen has an aperture;

the attachment portion has a mounting tab;

the mounting tab has an aperture; and an attachment member passes through the aperture in the platen and the aperture in the mounting tab to bias the platen to the chassis sidewall.

12. The printer according to claim 11, wherein the attachment member is a threaded member rotatably secured to the outer circumference of the aperture in the mounting tab.

13. The printer according to claim 11, wherein the aperture in the mounting tab and the aperture in the platen are aligned with the chassis sidewall.

14. A method for attaching a platen to a chassis sidewall, the method comprising the steps of:

providing a chassis sidewall having a flexible attachment portion;

providing a platen having a substantially flat platen surface configured to support media; and connecting the attachment portion to the platen by an attachment member, the connection flexing the attachment portion so as to bias the platen toward the chassis sidewall.

15. The method according to claim 14, further comprising the steps of:

providing a stop tab on the attachment portion; and assembling the attachment member to the attachment portion until the stop tab substantially abuts the chassis sidewall.

16. The method according to claim 14, further comprising the steps of:

providing a mounting plate;

positioning the mounting plate between the platen and the chassis sidewall;

connecting the attachment portion to the chassis sidewall until the mounting plate is retained between the platen and the chassis sidewall.

17. A printer comprising:

a chassis sidewall;

a platen having a substantially flat platen surface configured to support a print medium; and an attachment means connected to the chassis sidewall for connecting the chassis sidewall to the platen and biasing the platen toward the chassis sidewall.

18. A printer comprising:

a chassis sidewall having at least one location datum tab;

a platen having a substantially flat platen surface configured to support print medium; and an attachment portion attached to the chassis sidewall and the platen and drawing the platen toward the datum tab on the chassis sidewall to prevent the platen from moving away from the chassis sidewall.

19. The printer according to claim 18, wherein the printer further comprises at least two location datum tabs positioned on opposite sides of the attachment portion on the chassis sidewall to prevent rotation of the platen with respect to the chassis sidewall about at least one axis.

20. The printer according to claim 18, further comprising a locking datum tab integrally formed with the chassis sidewall and interlockingly engaged with a receiving portion on the platen to prevent sliding movement between the platen and the chassis sidewall.

21. The printer of claim 18, wherein the attachment portion is connected to an underside of the platen.

22. The printer of claim 18, wherein the attachment portion includes a flexible portion extending parallel to the major axis of the platen.

23. The printer of claim 18, wherein the attachment portion is integral with the chassis sidewall.

24. The printer of claim 18, wherein the platen extends along a first axis and wherein the attachment portion is configured to suspend a mounting surface coupled to the platen while allowing the mounting surface to move along a second axis perpendicular to the first axis to move along a third axis perpendicular to the first axis and the second axis, and to rotate about the third axis.

25. The printer of claim 24 including a stop surface coupled to the mounting surface and configured to abut the chassis sidewall at a predetermined torque of the mounting surface about the third axis.

26. The printer of claim 18, wherein one of the chassis sidewall and the platen includes a locking datum tab and wherein the other of the chassis sidewall and the platen includes a receiving formation receiving the locking datum tab.

27. The printer of claim 26, wherein the platen extends along a first axis and wherein the locking datum tab extending along a second axis perpendicular to the first axis.

28. The printer of claim 18 including an attachment member coupled to one of the platen and the attachment portion and extending through an aperture formed in the other of the platen and the attachment portion.

29. The printer of claim 28, wherein the attachment portion extends through said one of the platen and the attachment portion.

30. A printer comprising:

a platen;

a chassis sidewall;

a locking datum tab extending from one of the platen and the chassis sidewall;

a receiving formation formed in the other of the platen and the chassis sidewall and receiving the locking datum tab; and an attachment portion coupled to the platen and the chassis sidewall such that the attachment portion is flexed to bias the platen toward the chassis sidewall.

31. A printer comprising:

a platen;

a chassis sidewall;

a mounting surface connected to the platen by a fastening member; and an attachment portion extending from the chassis sidewall and including a flex portion suspending the mounting surface such that the flex portion is flexed to bias the platen toward the chassis sidewall.

32. A printer, comprising:

a platen;

a chassis sidewall;

an attachment portion connected to the platen and chassis sidewall such that the attachment portion is flexed to bias the platen toward the chassis sidewall; and a mounting plate positioned between the chassis sidewall and the platen, wherein the attachment portion forces the mounting plate between the plate and the chassis sidewall.

33. A printer, comprising:

a platen;

a chassis sidewall;

an attachment portion connected to the platen and chassis sidewall such that the attachment portion is flexed to bias the platen toward the chassis sidewall;

a leg extending away from the chassis sidewall toward an inner area of the printer;

a flex portion connecting the leg with the chassis sidewall;

a mounting tab;

a second flex portion connecting the mounting tab to the platen; and wherein the flex portion and the second flex portion bias the platen toward the chassis sidewall.

34. A printer, comprising:

a platen having an aperture;

a chassis sidewall;

an attachment portion having a mounting tab with an aperture; and an attachment member passing through the aperture of the platen and the aperture of the mounting tab to connect the platen and chassis sidewall such that the attachment portion is flexed to bias the platen toward the chassis sidewall.

35. A method for attaching a platen to a chassis sidewall, the method comprising the steps of:

providing a chassis sidewall having a flexible attachment portion;

providing a platen;

connecting the attachment portion to the platen by an attachment member, the connection flexing the attachment portion so as to bias the platen toward the chassis sidewall;

providing a mounting plate;

positioning the mounting plate between the platen and the chassis sidewall; and connecting the attachment portion to the chassis sidewall until the mounting plate is retained between the platen and the chassis sidewall.

36. A platen support apparatus comprising:

a chassis sidewall;

a platen; and an attachment portion coupled to the chassis sidewall and engaging an underside of the platen, wherein the attachment portion is configured to resiliently bias the platen towards the chassis sidewall.

37. A platen support apparatus comprising:

a chassis sidewall;

a platen extending along an axis; and an attachment portion coupled to the chassis sidewall and the platen, wherein the attachment portion includes a flexible portion extending parallel to the axis of the platen.

38. A platen support apparatus comprising:

a chassis sidewall;

a platen extending along a first axis; and an attachment portion having a mounting surface, wherein the attachment portion is configured to suspend the mounting surface while allowing the mounting surface to move along a second axis perpendicular to the first axis, to move along a third axis perpendicular to the first axis and the second axis, and to rotate about a third axis.

* * * * *